United States Patent [19]

Klenk

[11] 4,204,667

[45] May 27, 1980

[54] SEMI-CIRCULAR STACK SHEET FEEDING APPARATUS

[75] Inventor: Emil Klenk, Murrhardt, Fed. Rep. of Germany

[73] Assignee: Maschinenbau Oppenweiler GmbH, Oppenweiler, Fed. Rep. of Germany

[21] Appl. No.: 908,834

[22] Filed: May 23, 1978

[30] Foreign Application Priority Data

Jun. 1, 1977 [DE] Fed. Rep. of Germany ..... 2724617

[51] Int. Cl.[2] ..... B65H 1/22

[52] U.S. Cl. ..... 271/3.1; 271/31; 271/94; 271/151; 271/157

[58] Field of Search ..... 271/3.1, 31, 94, 157, 271/151, 162, 37

[56] References Cited

U.S. PATENT DOCUMENTS

| | | | |
|---|---|---|---|
| 1,591,546 | 7/1926 | Olson . | |
| 1,898,535 | 2/1933 | Haupt . | |
| 2,138,995 | 12/1938 | Belluche . | |
| 4,010,945 | 3/1977 | Kistner | 271/3.1 X |

FOREIGN PATENT DOCUMENTS

| | | | |
|---|---|---|---|
| 2502790 | 7/1976 | Fed. Rep. of Germany | 271/151 |
| 392119 | 5/1933 | United Kingdom | 271/37 |
| 574443 | 1/1946 | United Kingdom | 271/37 |

*Primary Examiner*—Richard A. Schacher
*Attorney, Agent, or Firm*—Wigman & Cohen

[57] ABSTRACT

A semi-circular stack sheet feeding apparatus for supplying an imbricated stack of sheets to a sheet folding machine or the like is disclosed. The sheet feeding device has a delivery and diverting device for transporting the imbricated stack of sheets in a first delivery direction along the underside of a diverting drum, about a portion of the periphery of the drum and, in a second delivery direction, to a sheet removal platform. A removal device associated with the removal platform removes the uppermost sheet from the platform in a direction opposite the second delivery direction. A stop is provided on the removal platform against which the leading edges of the sheets strike and a stack height sensor is provided for sensing the number of sheets stacked on the removal platform. So long as the number of sheets in the stack is below a predetermined value, the stack height sensor maintains the drive of the delivery and diverting device engaged.

10 Claims, 3 Drawing Figures

SEMI-CIRCULAR STACK SHEET FEEDING APPARATUS

BACKGROUND OF THE INVENTION

The present invention relates to a semi-circular stack sheet feeding device having a lower supply platform, which can be loaded with imbricated stacks of sheets, having a delivery and diverting device, which transports the imbricated stack of sheets in a first delivery direction along the underside of a diverting drum as well as transporting said stack around said drum upwardly onto a removal platform in a second delivery direction, and having a removal device for removing the arriving, top-most sheet on the removal platform in a delivery direction opposite to the second delivery direction.

In the semi-circular stack sheet feeding device according to German Patent Application No. 2,502,790.1, an end switch is arranged at the end of the removal platform, which quickly shuts off the drive of the delivery and diverting device when it is activated by the leading edge of the uppermost sheet of the stack of such sheets lying on the removal platform. Because the removal device is usually controlled independently of the delivery of sheets onto the removal platform, an unequal imbrication of the sheets lying on the removal platform can lead to the problem that the top sheet is grasped by the removal device before such sheet reaches the end switch. This can lead to malfunctions during the further transport of the sheets delivered by the removal device. An unequal imbrication of the sheets lying on the removal platform does not result only when the sheets laid on the supply platform have been unequally imbricated. It can also be caused by the fact that the imbrication does not uniformly decrease as the sheets leave the diverting drum because of varying friction between successive sheets. It can occur that some sheets maintain the greater imbrication received during their travel around the diverting drum, and, therefore, the imbrication is completely eliminated in other sheets.

SUMMARY AND OBJECTS OF THE INVENTION

A primary objective of the invention is to provide a semi-circular stack sheet feeding device in which an unequal imbrication of the sheets lying on the removal platform has no adverse effects. This objective is achieved according to the invention with a semi-circular stack sheet feeding device of the type described above by providing a stop on the removal platform for the leading edge of the sheets transported to the removal platform, as well as by providing a sensor which determines the number of stacked sheets the leading edges of which abut said stop and holds the drive of the delivery and diverting device in the engaged condition so long as the number of these sheets is below a predetermined value.

In cooperation with the sensor, the stop also makes it possible to form a small stack on the removal platform and to continually maintain said small stack. In this manner, it makes no difference if the number of sheets forming this small stack fluctuates. The use of this type of small stack enables compensation for even relatively large differences in imbrication. It is, therefore, assured that a sheet having its leading edge against the stop is always present when the removal device is activated.

The removal device removes all of the sheets from a precisely defined position. It is also advantageous that known separating elements of a flat stack feeding device, such as a separating suction device, can be used to facilitate the separation of the uppermost sheet from the lower sheets. The control of the height of the stack can take place by means of detectors which are known in these conventional separating means.

In the preferred embodiment, the sensor is formed as a mechanical or capacitive stack thickness detector, because these types of detectors operate very reliably and are sufficiently sensitive.

The number of sheets to be selected to form the stack depends on various factors, such as the thickness of the sheets and their size. The sensor is, therefore, preferably adjustable to different stack thicknesses. In the preferred embodiment, the stack thickness detector has a setting device having a feeler which can be laid on a stack of corresponding height. One then need only form a stack of the desired height from the delivered sheets, position this stack under the feeler and set the feeler in such a manner that it comes into contact with the stack. The stack thickness detector will then automatically assume the correct position.

BRIEF DESCRIPTION OF THE DRAWINGS

In the following, the invention is described in detail with the aid of an exemplary embodiment shown in the drawings, wherein.

DETAILED DESCRIPTION OF A PREFERRED EMBODIMENT

Figure 1:
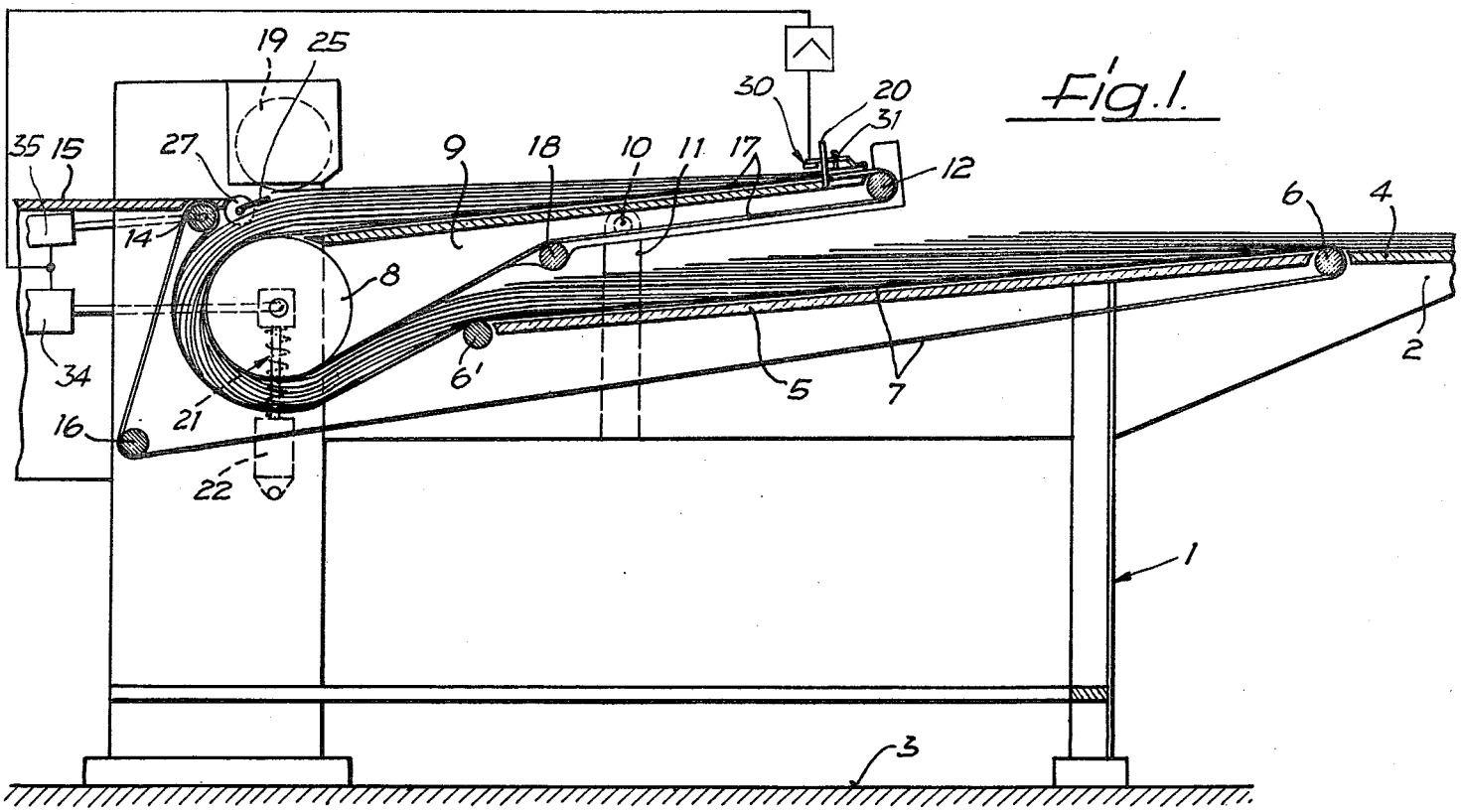
FIG. 1 shows a schematically illustrated side view of the exemplary embodiment.

A semi-circular stack sheet feeding device, especially one which is provided for the feeding of individual sheets of selectable format to a folding machine, but which could also be utilized in conjunction with other processing machines, has a machine frame 1, which supports a supply platform 2 is located above the rear side of the machine frame 1. The height of the supporting surface of the supply platform 2 above the floor surface 3, upon which the machine frame 1 stands, is about 90 centimeters in the exemplary embodiment, but could also be selected to be somewhat lower or higher. It is even possible to connect the supply platform 2 with the machine frame 1 in such manner that its height can be adjusted. In the open end section of the supply platform 2, the supporting surface is formed by a plate 4 or by parallel, separated rails, which are directed toward the machine frame 1. A plate 5 is arranged adjacent the plate 4 in such manner that an intermediate space is formed therebetween. The width of this plate 5, just as that of the plate 4, determines the width of the supply platform 2. The plate 5 extends, as shown in FIG. 1, beyond the end of the supply platform opposite the plate 4, and is inclined in the same direction. In the exemplary embodiment, the angle of inclination is about 10°.

A first diverting roller 6 is arranged in the intermediate space between the plates 4 and 5 in such manner that its upper side lies in the surface defined by the upper side of the plates 4 and 5. Several conveyor bands or belts 7 are guided over the diverting roller 6, running in a known manner spaced from each other, each being an endless band.

The delivery bands 7 lie on the plate 5 over the entire length of the plate and form the supporting surface for the sheets that are to be processed and, therefore, also lie on a partial area of the supply platform 2. The sheets are laid on the supply platform 2 in imbricated stacks. A second diverting roller 6' is arranged at the end of the plate 5 so as to divert the delivery bands 7 downwardly as they leave the plate 5. Of course, individual rollers for each band could also be used in place of the diverting rollers 6, 6'.

The second diverting roller 6' is disposed at a distance from a diverting drum 8 mounted in the machine frame 1. The diverting drum 8, whose axis lies parallel both to the axes of the first diverting roller 6 and the second diverting roller 6', has a diameter which is common in semi-circular stack sheet feeding devices. It is rotatably mounted on the end of a removal platform 9 opposite the supply platform 2, which removal platform 9, in turn, is mounted in the machine frame 1 at a distance above the plate 5 and the delivery bands 7 about an axis 10 which is parallel to the axis of the diverting drum 8. Plates 11 for mounting the removal platform 9 are arranged on the sides next to the plate 5 and, therefore, do not interfere with the transport of the sheets from the supply platform to the diverting drum 8. The distance of the removal platform 9 above the plate 5 is also selected to be great enough that even sheet stacks of great height can be transported without difficulty. The extension of the removal platform 9 toward the delivery bands 7 is selected in such manner that the end formed by a third diverting roller 12 and confronting the supply platform 2 is located above a point of the plate 5 which has a distance of about 1 meter to 1.25 meters from the downstream edge of the plate 4. The opposite end of the removal platform 9 is formed by the diverting drum 8.

As FIG. 1 shows, the position of the axis 10, about which the removal platform 9 can be pivoted, is selected in such manner that the flat supporting surface of the removal platform 9 can be selectively brought into a horizontal plane or a plane which is inclined from the third diverting roller 12 toward the diverting drum 8. In each selectable position of the removal platform 9, however, the underside of the diverting drum 8 lies lower than the plate 5.

The delivery bands 7, which together with the diverting drum 8 and the associated diverting rollers, form a portion of a delivery and diverting device, extend according to the diverting mechanism past the second diverting roller 6' downwardly toward the diverting drum 8, about which the bands run lying against the sheets being diverted thereby, and upwardly to a fourth diverting roller 14, which is mounted in the machine frame 1 on an axis parallel to the axis of the diverting drum 8. The position of the fourth diverting roller 14, as shown in FIG. 1, is selected in such manner that its upper surface lies only slightly beneath the transport track or path 15, on which the individual sheets are guided to a folding machine or the like. The height of the transport path 15 above the floor surface 3 is about 1 meter in the exemplary embodiment, and is thereby set at the height necessary for the folding machine. The surface of the fourth diverting roller 14 confronting the supply platform 2 is tangential to a vertical plane, which is also tangential to the diverting drum 8. The delivery bands 7, therefore, encircle the sheet stack being guided around the diverting drum 8 over an angle of nearly 180°. From the fourth diverting roller 14 the delivery bands 7 are guided downwardly and away from the diverting drum 8 to a tension roller 16, from which they again return to the diverting roller 6.

A second set of delivery bands 17, which are spaced from each other in the same manner as the delivery bands 7, are guided over the third diverting roller 12 and the upper side of the removal platform 9. They thus encircle the diverting drum 8 over an angle of somewhat more than 180° and then run parallel to the section of the delivery bands 7 located between the second diverting roller 6' and the lowermost point of the sheet stack. A fifth diverting roller 18, which is arranged at a distance above the plate 5, guides the transport bands 17 to the third diverting roller 12 in a path parallel to the supporting surface of the removal platform 9.

A suction wheel 19 is arranged above the diverting drum 8 on an axis parallel to the axis of the diverting drum 8 as a removal device. The suction wheel as seen in FIG. 1, rotates clockwise, so that it can deliver the respective uppermost sheet of the sheets lying on the removal platform 9 onto the transport track 15. The delivery direction of the suction wheel 19 is, therefore, opposed to the second delivery direction, or the delivery direction of the transport bands 17, which also form a portion of the delivery and diverting device. The suction wheel 19 is controlled by photoelectric devices which are not shown.

An adjustable stop 20 is arranged on the end of the removal platform 9 toward the supply platform 2, against which the leading edges of the sheets strike as they are delivered onto the removal platform 9. The adjustable stop 20, therefore, holds the sheets which have been delivered to that point in a precisely defined position.

Figure 3:
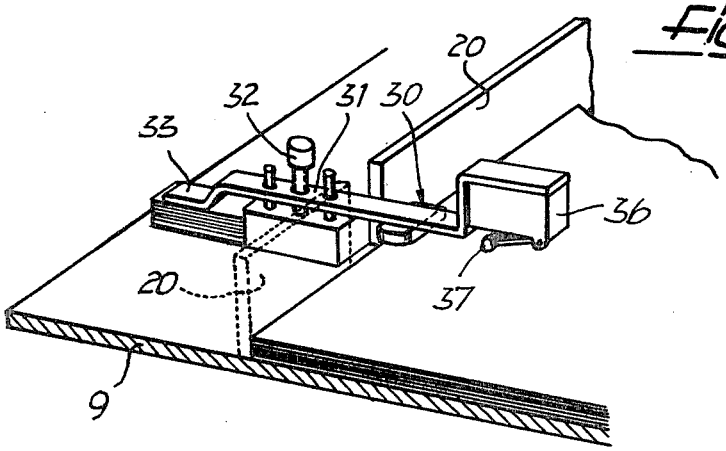
FIG. 3 shows an enlarged, schematically illustrated view of the stack thickness detector.

As best seen in FIG. 3, a stack thickness detector 30 is arranged centrally at the end of the removal platform which supports the stop 20. This stack thickness detector 30 responds to the thickness of the stack formed by the sheets lying against the stop 20 and controls the drives 34 and 35, as shown in FIG. 1, of the diverting drum 8 and of the delivery bands 7 and 17 in such manner that such drives 34 and 35 remain engaged until a predetermined stack thickness, corresponding to a certain number of sheets, has been attained. The stack thickness detector holds the drives 34 and 35 disengaged only so long as this predetermined stack thickness is exceeded.

The stack thickness detector 30, which determines the stack thickness capacitively in the exemplary embodiment, but which could also be a 36 microswitch with a contact roller 37 shown in FIG. 3, can be adjusted with the aid of a setting device 31 to the desired stack thickness. The setting device 31 has, as FIG. 3 shows, an adjusting screw 32 and a feeler 33. The stack thickness detector 30 is attached to the setting device 31 in such a manner that it is located at the correct distance above the removal platform 9 when the feeler 33, whose height can be adjusted by means of the adjusting screw 32, is lying on a stack, whose thickness is equal to the desired thickness of the stack on the removal platform 9. For adjustment, therefore, one need only stack the number of sheets which the stack to be formed on the removal platform 9 should contain and lay them under the feeler 33.

Figure 2:
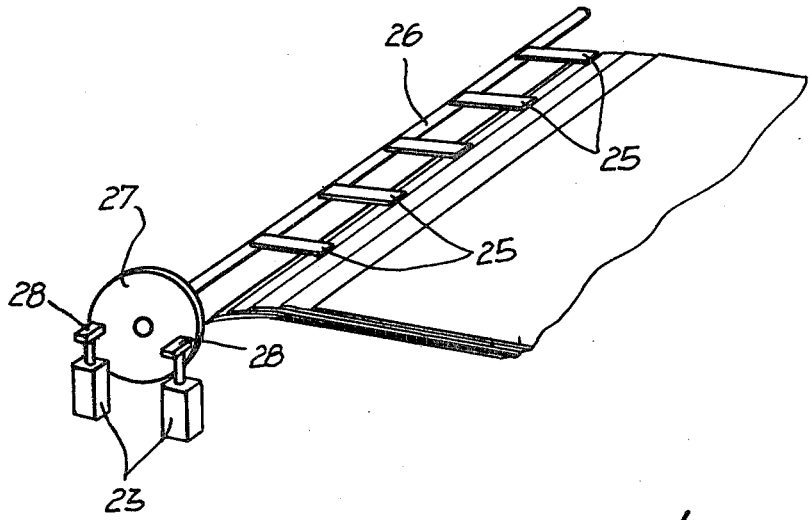
FIG. 2 shows a perspective view of a portion of the height setting regulator.

In order that the rear edge zone (as seen according to the delivery direction of the delivery bands 17, but front edge zone as seen in the delivery direction of the suction wheel 19) of the respective uppermost sheet always has at least nearly the same distance from the suction wheel 19, a height adjustment device 21 (FIG. 1) is associated with the diverting drum 8. This height adjustment device 21, however, could also be engaged at the removal platform 9, because said platform 9 is rotated during a height adjustment of the diverting drum 8. The height adjusting device 21 has a motor 22, which pushes upwardly or downwardly depending on the direction of rotation of the diverting drum 8 and does so by means of a spindle, which motor 22 is controlled in the exemplary embodiment by two end switches 23 (FIG. 2). The height of the sheets is determined in the smallest possible distance from the rear edge (as seen from the second delivery direction) of the respectively uppermost sheet in the area of the rear edge zone of one of the following sheets which has already been released from the delivery bands 7, with the aid of tongues 25. These tongues 25 are attached to a shaft 26, which is mounted in the machine frame 1 parallel to the longitudinal axis of the diverting roller 14 in the region between the diverting roller 14 and the suction wheel 19 and is arranged beneath the transport path of the suction wheel 19. Shaft 26 is rotatable, so that the tongues 25 extend from the shaft 26 toward the rear edge of the respective uppermost sheet (see FIG. 2). At the side outside the transport path of the suction wheel 19 a disc 27 is rigidly mounted on the shaft 26, and is provided with two projections 28, each of which activates a respective one of the two end switches 23. The two projections 28 and the end switches 23 are set in such a manner that, in the angular position of the shaft 26 which corresponds to the largest distance of the sheet from the suction wheel 19, the end switch 23 which engages the motor 22 in the sense of a movement of the diverting drum 8 upward, is activated, and in the angular position which corresponds to the smallest distance of the sheets from the suction wheel 19, the end switch 23 which engages the motor 22 in the opposite sense, is activated. The height of the diverting drum 8 and, thereby, that of the uppermost sheet is thus held within the set range by a two-point regulator.

In place of a regulator of this type for the height adjustment of the diverting drum, one can provide pretensed springs, shown by broken lines at the height adjustment device 21 in FIG. 1, which springs are biased to move the diverting drum 8 upwardly. The fourth diverting roller 14 then forms a stop body which determines the height adjustment of the diverting drum 8 in dependence on the height of the sheet stack.

In order to facilitate the removal of the respective uppermost sheet by means of the suction wheel 19, air jets can be provided at the beginning of the transport path 15 toward the suction wheel 19, which blow air beneath the uppermost sheet.

Although only a preferred embodiment is specifically illustrated and described herein, it will be appreciated that many modifications and variations of the present invention are possible in light of the above teachings and within the purview of the appended claims without departing from the spirit and intended scope of the invention.

What is claimed is:

1. In a semi-circular sheet feeding apparatus having a supply platform adapted to be loaded with an imbricated stack of sheets and a removal platform, delivery and diverting means including a diverting drum for transporting the imbricated stack of sheets in a first delivery direction along a lowermost periphery of said drum, about the drum and, in a second delivery direction, onto the removal platform and means for driving said delivery and diverting means, and means arranged downstream of the removal platform for removing the uppermost sheet on the removal platform in a direction opposite the second delivery direction, the improvement comprising stop means provided on said removal platform for abutment of the leading edges of the sheets transported to the removal platform and stack height detection and drive control means for sensing the number of stacked sheets lying with their leading edges against said stop means and for maintaining said drive means engaged with said delivery and diverting means until a predetermined number of stacked sheets on the removal platform is sensed.

2. The improvement according to claim 1, wherein said stack height detection and drive control means includes a capacitive stack thickness detector.

3. The improvement according to claim 1, wherein said stack height detection and drive control means includes a mechanical detector.

4. The improvement according to claim 2, wherein said stack thickness detector includes a stack height setting device having feeler means for engaging a stack of sheets the number of which corresponds to said predetermined number.

5. The improvement according to claim 1, including means for mounting said diverting drum for vertical height adjustment, said means including a resilient element biasing said drum upwardly and means for providing an abutment body for the downstream edge of the stack of sheets on the removal platform, said abutment body being located immediately downstream of a point at which the removing means removes said uppermost sheet on the removal platform.

6. The improvement according to claim 1, wherein said removal platform has two ends, one of which is arranged adjacent the diverting drum, said one end being arranged at a height equal to or lower than the other end of said removal platform.

7. The improvement according to claim 6, wherein said other end of the removal platform is arranged above the downstream end of the supply platform which confronts the diverting drum.

8. The improvement according to claim 1, including means for pivotally mounting said removal platform about an axis transverse to the axis of the diverting drum.

9. The improvement according to claim 1, wherein said lowermost periphery of the diverting drum is arranged beneath a stacking surface of the supply platform.

10. The improvement according to claim 1, wherein said removing means includes a suction wheel having an axis parallel to that of the diverting drum and arranged in a region above the downstream edge of the uppermost sheet of the stack of sheets on the removal platform.

* * * * *